United States Patent [19]

Braun et al.

[11] 4,318,822

[45] Mar. 9, 1982

[54] PRODUCTION OF AGENT FOR DESULFURIZING CRUDE IRON AND STEEL MELTS

[75] Inventors: Albert Braun, Hürth; Willi Portz; Georg Strauss, both of Erftstadt, all of Fed. Rep. of Germany

[73] Assignee: Hoechst Aktiengesellschaft, Frankfurt am Main, Fed. Rep. of Germany

[21] Appl. No.: 149,745

[22] Filed: May 14, 1980

[30] Foreign Application Priority Data

May 19, 1979 [DE] Fed. Rep. of Germany ..... 2920353

[51] Int. Cl.[3] ..... C01B 31/32; C21C 1/02; C21C 7/064

[52] U.S. Cl. ..... 252/189; 75/55

[58] Field of Search ..... 252/189; 75/55

[56] References Cited

U.S. PATENT DOCUMENTS 3,473,917 10/1969 Michaelis ..... 75/55 X 4,115,518 9/1978 Delmon et al. ..... 252/189 X

*Primary Examiner*—Richard A. Schwartz

*Attorney, Agent, or Firm*—Connolly and Hutz

[57] ABSTRACT

The invention relates to the production of an agent for desulfurizing crude iron and steel melts, the desulfurizing agent being based on calcium carbide containing calcium oxide. To this end, a calcium carbide/calcium oxide/starting melt mixture with a CaO-content within the range 20 to 80 weight % is produced from lime and coke and allowed to solidify to a block. While the solidified block still has an average temperature of more than 400° C., it is crushed to particulate material with a size of less than 150 mm. Next, the hot crushed material of at least 400° C. is admixed with a quantity of calcium oxide necessary to have in the resulting mixture an overall content of CaO corresponding to that desired for the final product. The whole is thoroughly mixed and crushed with exclusion of moisture at temperatures higher than 100° C. to particulate material with a size of less than 10 millimeters.

6 Claims, No Drawings

PRODUCTION OF AGENT FOR DESULFURIZING CRUDE IRON AND STEEL MELTS

The present invention relates to a process for making an agent for desulfurizing crude iron and steel melts, the desulfurizing agent being based on calcium carbide containing calcium oxide.

It is generally accepted that crude iron and steel melts can be desulfurized with the use of calcium carbide (briefly termed carbide hereinafter) containing calcium oxide (briefly termed lime hereinafter); cf. German Pat. Nos. 1 160 457 and 20 37 758.

In preparing these desulfurizing agents, it has heretofore been customary to admix a liquid carbide melt with a quantity of fine particulate lime necessary to have a homogeneous mixture in the melt. Next, the whole is allowed to cool, and crushed.

More specifically, it has heretofore been customary, to introduce fine particulate lime into the jet of carbide tapped off from the furnace. Despite the fact that a carbide melt can be admixed with a limited quantity of lime only and that liquid carbide is hazardous to handle, the method just described has long been held in the art to be irreplaceable. More particularly, a $CaC_2$/CaO-mixture prepared in the melt has long been held to be ideally suitable for use in the desulfurization of metal melts.

The present invention now unexpectedly provides a process for making a highly efficient agent for desulfurizing crude iron and steel melts, which avoids the adverse effects encountered with the methods described heretofore and which comprises: thermally producing, from lime and coke, a calcium carbide/calcium oxide-starting melt mixture with a CaO-content within the range 20 to 80 weight%; allowing the starting melt mixture to solidify to a block; allowing the solidified block to assume an average temperature of more than 400° C., preferably a temperature between 400° C. and the solidification point of the melt, and precrushing it at that temperature to particulate material with a size of less than 150 mm; admixing the hot crushed material of at least 400° C. with a quantity of CaO necessary to have in the resulting mixture an overall content of CaO corresponding to that desired for the final product, preferably a CaO-content of more than 45 up to 90 weight%; thoroughly mixing and crushing the whole with exclusion of moisture at temperatures higher than 100° C. to particulate material with a size of less than 10 millimeters, preferably less than 10 microns; and cooling the ground pulverulent material, with exclusion of moisture.

It is good practice to use as the calcium carbide/calcium oxide-starting melt mixture one which contains 20 to 45 weight% of CaO and has been prepared thermally in customary manner, from lime and coke. It is also possible, however, by admixing a calcium carbide melt having up to 45 weight% of calcium oxide therein with fine particulate calcium oxide so as to establish a CaO-content of up to 80 weight% initially to produce a calcium carbide/calcium oxide starting melt mixture which is allowed to solidify to give a block and the latter is precrushed at temperatures higher than 400° C.

The present invention avoids the need to mix lime with a carbide melt and the difficulties which are associated with this. Further technically beneficial effects reside in the following: the carbide melt can be produced without the need to use a specifically composed burden in each particular case or to grind lime to a given particle size. Instead of this, use can be made in the present process of a carbide block of which the $CaC_2$:CaO-ratio by weight may vary within very wide limits, i.e. which may practically be selected at will; also, use can be made of coarse particulate material with a size of 8 to 60 mm, for example.

EXAMPLE 1

A melt with a $CaC_2$-content of 80 weight% and a CaO-content of 20 weight% as customarily used in the production of commercial carbide was placed in a crucible and allowed to cool therein to a carbide block of analogous composition.

Once the block was found to have cooled down to an average temperature of about 600° C., it was precrushed to particulate material with a size of less than 150 mm. Next, the hot carbide of 500° C. was covered with a quantity of lime (in the form of particles with a size of 8 to 60 mm) necessary to obtain a mixture with an overall CaO-content of 50 weight%.

Next, the mixture was ground at 100° C. with exclusion of moisture to particles with a size of up to 100 microns and the ground product was cooled to room temperature, with exclusion of moisture.

1500 kg of the product so made was used for desulfurizing 300 000 kg of a crude iron melt in customary manner, of which the sulfur content initially of 0.03 weight% was reduced down to less than 0.005 weight%.

EXAMPLE 2

Calcium carbide was produced thermally in customary manner, from lime and coke. The furnace burden contained the lime/coke-mixture in a ratio by weight of about 110:40. This corresponded to carbide containing about 45 weight% of CaO.

Introduced into the jet of liquid carbide tapped off was CaO in the form of particles with a size of 3 to 8 mm, which was used in a quantity necessary to have an average CaO-content of about 80 weight% in the crucible (about 1.2 to 1.3 metric tons of CaO per ton of material tapped off).

The material in the crucible was allowed to cool down to an average temperature of not less than 600° C. which was the case after 4 hours. Next, the block was precrushed to particulate material with a size of less than 150 mm and a quantity of lime (particles 8 to 60 mm) necessary to produce an average CaO-content of 90 weight% was poured over the precrushed material. After this had been done, the whole was ground at a temperature higher than 100° C. with exclusion of moisture to particulate material with a size of less than 100 microns, and the pulverulent product was cooled to room temperature with exclusion of moisture.

The product so made was used as a desulfurizing agent and found to produce the same results (based on its calcium carbide content) as the product used in Example 1.

We claim:

1. A process for making an agent for desulfurizing crude iron and steel melts, the desulfurizing agent being based on calcium carbide containing calcium oxide, which comprises: producing, from lime and coke, a calcium carbide/calcium oxide-starting melt mixture with a CaO-content within the range 20 to 80 weight%; allowing the starting melt mixture to solidify to a block; allowing the solidified block to assume an average temperature of more than 400° C. and precrushing it at that temperature to particulate material with a size of less than 150 mm; admixing the hot crushed material of at least 400° C. with a quantity of calcium oxide necessary to have in the resulting mixture an overall content of CaO corresponding to that desired for the final product; thoroughly mixing and crushing the whole with exclusion of moisture at temperatures higher than 100° C. to particulate material with a size of less than 10 millimeters; and cooling the ground pulverulent material, with exclusion of moisture.

2. The process as claimed in claim 1, wherein the precrushed block has coarse particulate CaO with a size of 8 to 60 mm poured over it.

3. The process as claimed in claim 1, wherein the precrushed block has a quantity of CaO poured over it which is necessary for the resulting mixture to contain 45 to 90 weight% of CaO.

4. The process as claimed in claim 1, wherein the solidified starting melt mixture is precrushed at temperatures lying between 400° C. and the solidification temperature of that mixture.

5. The process as claimed in claim 1, wherein the calcium carbide/calcium oxide-starting melt mixture containing 20 to 45 weight% of CaO is one which has been produced thermally in customary manner from lime and coke.

6. The process as claimed in claim 1, wherein the calcium carbide/calcium oxide-starting melt mixture containing more than 45 up to 80 weight% of CaO is produced by admixing a calcium carbide melt having up to 45 weight% of calcium oxide therein with fine particulate calcium oxide so as to establish a CaO-content of at most 80 weight% and allowing the whole to solidify to a block.

* * * * *